US008025533B2

(12) United States Patent
Takata

(10) Patent No.: US 8,025,533 B2
(45) Date of Patent: Sep. 27, 2011

(54) LED ILLUMINATION APPARATUS

(75) Inventor: Taketo Takata, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/815,244

(22) Filed: Jun. 14, 2010

(65) Prior Publication Data

US 2011/0117785 A1 May 19, 2011

(30) Foreign Application Priority Data

Nov. 13, 2009 (JP) ..... 2009-259493
Feb. 11, 2010 (JP) ..... 2010-028309

(51) Int. Cl.
*H01J 5/54* (2006.01)

(52) U.S. Cl. ..... 439/617

(58) Field of Classification Search ..... 439/628, 439/617, 612
See application file for complete search history.

(56) References Cited

U.S. PATENT DOCUMENTS 7,052,171 B1 * 5/2006 Lefebvre et al. ..... 362/649

FOREIGN PATENT DOCUMENTS

JP 2001-351402 A 12/2001
JP 2008-282793 A 11/2008
JP 3148176 U 2/2009

OTHER PUBLICATIONS

Applicants bring the attention of the Examiners to the following pending U.S. Appl. No. 12/815,251, filed Jun. 14, 2010.

* cited by examiner

*Primary Examiner* — Javaid Nasri
(74) *Attorney, Agent, or Firm* — Chen Yoshimura LLP

(57) ABSTRACT

Parts exchange or the like is not easy with an LED illumination apparatus that uses an LED attached to a socket of a conventional fluorescent light fixture. Other problems also exist such as unfavorable operability and reliability, and necessitating additional parts. Provided herewith is an LED illumination apparatus including a cap having a terminal electrically coupled to a socket of a fluorescent light fixture and a main body having an end coupled with the cap, where the main body includes an LED and a coupler to electrically couple the terminal to the LED, the terminal being fitted in the coupler.

2 Claims, 14 Drawing Sheets

LED ILLUMINATION APPARATUS

BACKGROUND

1. Technical Field

The present invention relates to an LED illumination apparatus that uses an LED (light emitting diode) attached to a socket of a fluorescent light fixture. The contents of the following patent application is incorporated herein by reference, NO. 2009-259493 filed on Nov. 13, 2009, and NO. 2010-028309 filed on Feb. 11, 2010.

2. Related Art

LED illumination apparatuses that use a white LED with high luminance, energy saving capability, and long life have already been developed to replace conventional illumination apparatuses such as fluorescent lamps.

Patent Document No. 1: Japanese Patent Application Publication No. 2001-351402

Patent Document No. 2: Japanese Patent No. 4156657

Patent Document No. 3: Japanese Utility Model Registration No. 3148176

Patent Document No. 1 proposes an LED illumination apparatus that can be attached to an already-installed fluorescent light fixture with ease.

Patent Document No. 2 proposes an LED illumination apparatus that is assembled efficiently.

FIG. 11 shows an internal structure of a conventional LED illumination apparatus. The LED illumination apparatus includes a main body 1, a cap 3, a print substrate 4, a plurality of LEDs 5, and an electric wire 7, where the cap 3 holds a pair of pin terminals 2 attachable to an already-installed fluorescent light fixture and is joined to the main body 1, the print substrate 4 is accommodated in the main body 1 and has an electric control circuitry mounted thereon, the plurality of LEDs 5 are mounted to the print substrate 4, the electric wire 7 has one end connected to the print substrate 4 and the other end connected to the pair of pin terminals 2, and the pair of pin terminals 2 and the electric terminal 7 are connected to each other by swaging or soldering. The connection by waging or soldering is not only difficult to work with, but also the electric wire, once connected, is structurally difficult to be removed, and the parts exchange is difficult to pursue.

Patent Document No. 3 proposes an LED illumination apparatus having an LED illumination section and/or the LED itself exchangeable. The structure of bringing the contacts into contact with each other has a possibility of causing outage and contact failure, which is not favorable as an illumination apparatus.

Wiring in some fluorescent light fixtures is such that only one pole of the pair of electrodes of the socket 8 is connected to the power source, as shown in FIG. 12. Therefore, both of the pin terminals 2 should be connected to the print substrate 4. One method to realize this is to connect both of the pin terminals 2 to the print substrate 4 via two electric wires, as shown in FIG. 11. Another method is to connect a round terminal 9*a* to one end of the electric wire 7 drawn from the print substrate 4, to be connected to a pin terminal 2 using screw, as shown in FIGS. 13A and 13B. Note that the round terminal 9*a* and a round terminal 9*b* that is different from the round terminal 9*a* are short circuited therebetween using a jumper line 10, and the round terminal 9*b* is connected to another pin terminal 2 using screw.

SUMMARY

In this way, with a conventional method, parts exchange and the like are difficult. Other problems also exist such as unfavorable operability and reliability, and necessitating additional parts.

So as to solve the above-stated problems, according to a first aspect of the innovations herein, provided is an LED illumination apparatus including: a cap having a terminal electrically coupled to a socket of a fluorescent light fixture; and a main body having an end coupled with the cap, where the main body includes: an LED; and a coupler to electrically couple the terminal to the LED, the terminal being fitted in the coupler.

In the above-stated LED illumination apparatus, the coupler may be removably coupled with the terminal. In the above-stated LED illumination apparatus, the coupler may include a lock section removably coupled with a groove formed on the terminal. The above-stated LED illumination apparatus may have such a structure that the lock section has flexibility or elasticity, and by means of the flexibility or the elasticity, the lock section removably couples the terminal to the coupler.

In the above-stated LED illumination apparatus, the coupler may be removably coupled with the cap. In the above-stated LED illumination apparatus, the coupler may include a lock section removably coupled with a lock engaging section formed on the cap. The above-stated LED illumination apparatus may have such a structure that the lock section has flexibility or elasticity, and by means of the flexibility or the elasticity, the lock section removably couples the cap to the coupler.

In the above-stated LED illumination apparatus, the cap may include a holding section to hold the coupler. In the above-stated LED illumination apparatus, the terminal may be electrically insulated from the cap. The above-stated LED illumination apparatus may have such a structure that the terminal is a pair of pin terminals, and the coupler is electrically coupled with both of the pair of pin terminals. In the above-stated LED illumination apparatus, the coupler may be an integrally formed metal plate.

In the above-stated LED illumination apparatus, the main body may further include an electric wire to electrically couple the coupler with the LED. The above-stated LED illumination apparatus may have such a structure that the main body further includes a print substrate provided with the LED and an electric control circuitry, and the electric wire has an end connected to the coupler and the other end connected to the print substrate.

The above structure allows to exchange the parts such as an LED illuminating section and/or the LED itself with ease.

DESCRIPTION OF EXEMPLARY EMBODIMENTS

Figure 1:
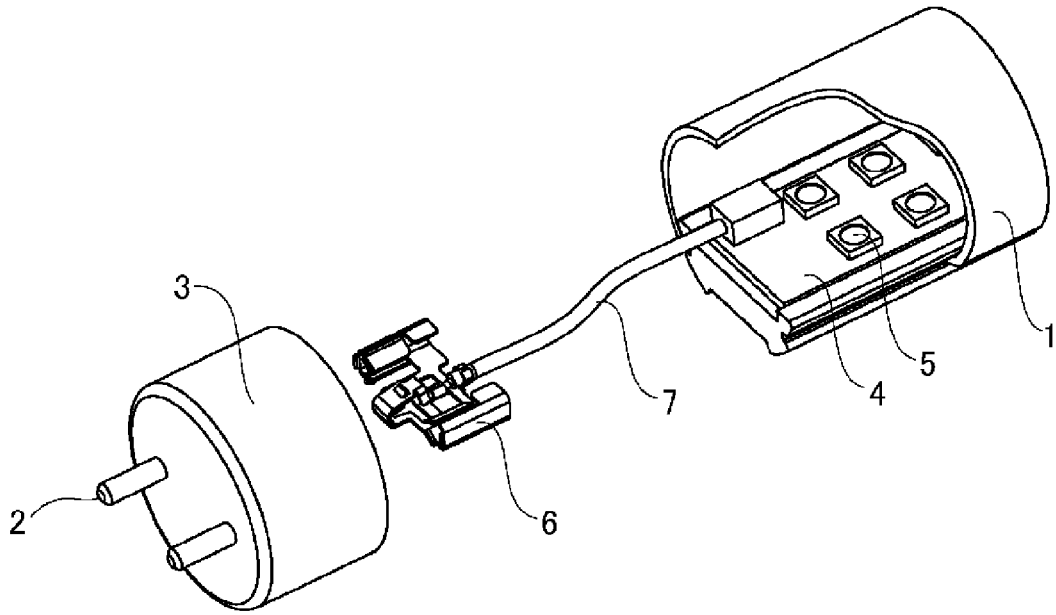
FIG. 1 is an exploded view of an LED illumination apparatus according to the present invention (Embodiment Example 1).
Figure 2:
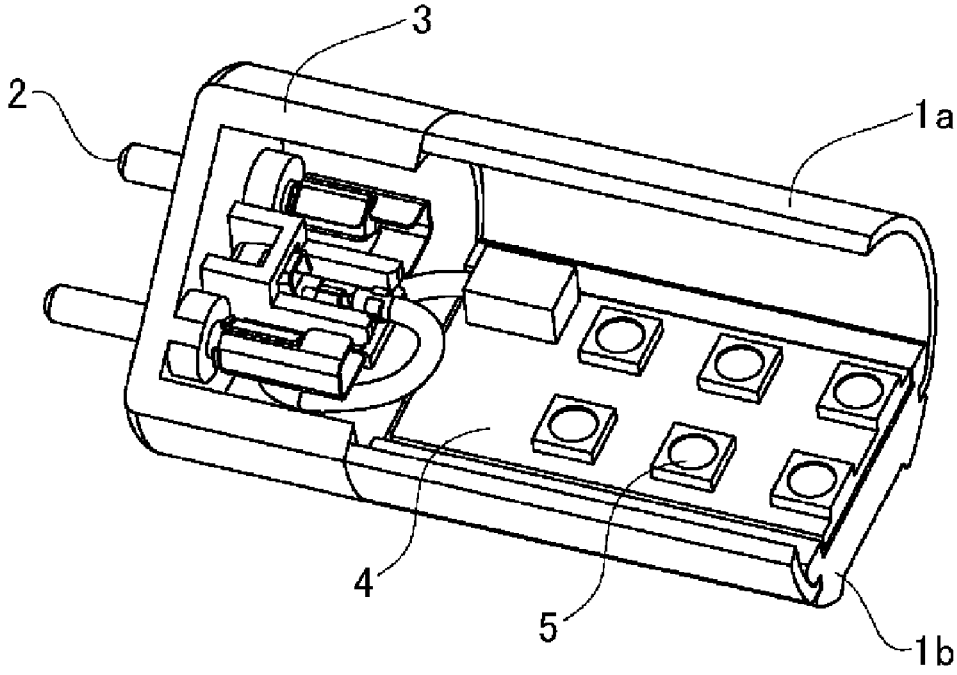
FIG. 2 is a sectional view of the LED illumination apparatus according to the present invention (Embodiment Example 1).

As shown in FIG. 1 and FIG. 2, an LED illumination apparatus according to the present embodiment holds a main body 1, a cap 3, a print substrate 4, an LED 5, a connecting terminal 6, and an electric wire 7, where the cap 3 holds a pair of pin terminals 2 fitted to a socket 8 of a fluorescent light fixture and is joined to the main body 1, the print substrate 4 is accommodated in the main body 1 and has an electric control circuitry mounted thereon, the LED 5 is mounted to the print substrate 4, the connecting terminal 6 is for connection with the pair of pin terminals 2, and the electric wire 7 has one end connected to the print substrate 4 and the other end connected to the connecting terminal 6.

The pair of pin terminals 2 are electrically coupled to the socket 8 of the fluorescent light fixture. The connecting terminal 6 electrically couples the pair of pin terminals 2 and the LED 5. The pair of pin terminals 2 are fitted into the connecting terminal 6. The connecting terminal 6 is removably coupled to the pair of pin terminals 2. The connecting terminal 6 may be an integrally formed metal plate. The pair of pin terminals 2 may be an example of a terminal connected to a socket of a fluorescent light fixture. The connecting terminal 6 may be an example of a coupler.

In the present embodiment, the pair of pin terminals 2 are provided through a cap. However, the pair of pin terminals 2 are not limited to this structure. The pair of pin terminals 2 may include a member fitted to a socket, and a member connected to the connecting terminal 6, so that both of the member fitted to a socket and the member connected to the connecting terminal 6 be electrically coupled to each other.

The term "electrically coupled" or the derivatives thereof may refer to a case where the corresponding members are in contact with each other, and not limited to a case in which the members are electrically connected to each other. The term "electrically coupled" or the derivatives thereof may also include a case where the members form a part of the electric path.

Embodiment Example 1

The main body 1 is a combination between an optical diffusion section 1*a* made of a transparent or semi-transparent resin (e.g. polycarbonate resin) and a heat dissipating section 1*b* made of an aluminum alloy or the like, and has a cylindrical form. However, the heat dissipating section 1*b* may be created as a heat sink having convex and concave portions. Note that the main body 1 is not limited to the described combination, and may be made of only a resin.

Figure 3:
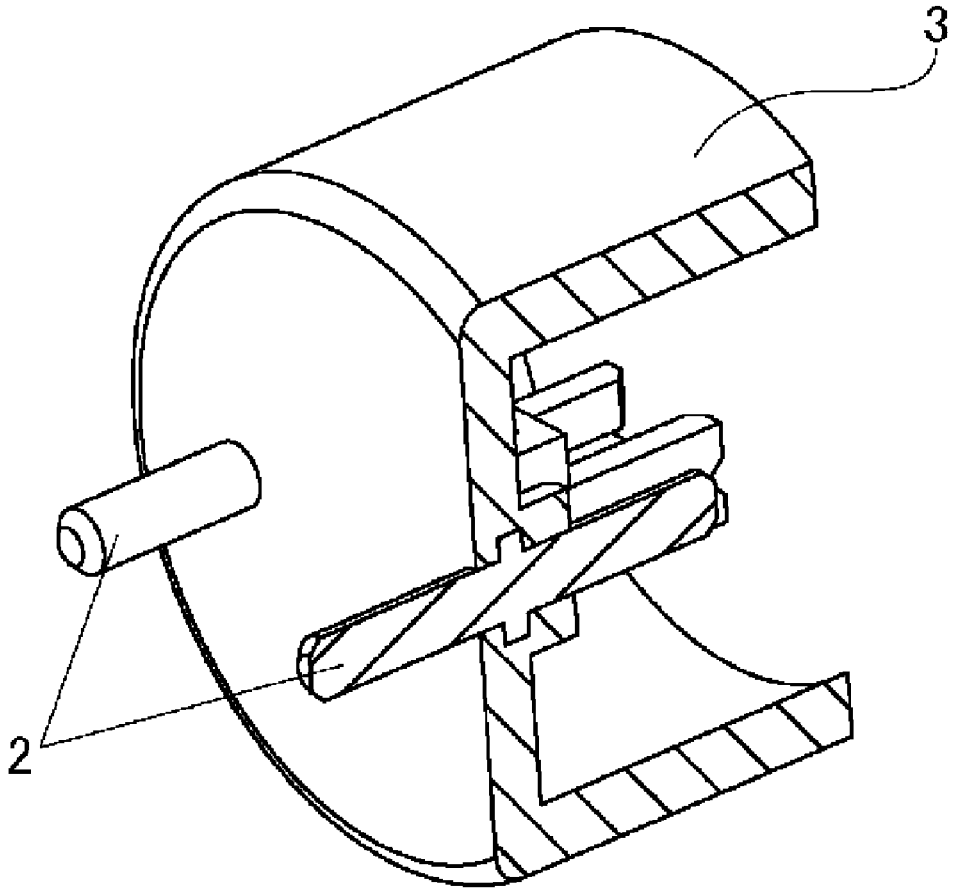
FIG. 3 is a sectional view of a cap 3 according to Embodiment Example 1.
Figure 4:
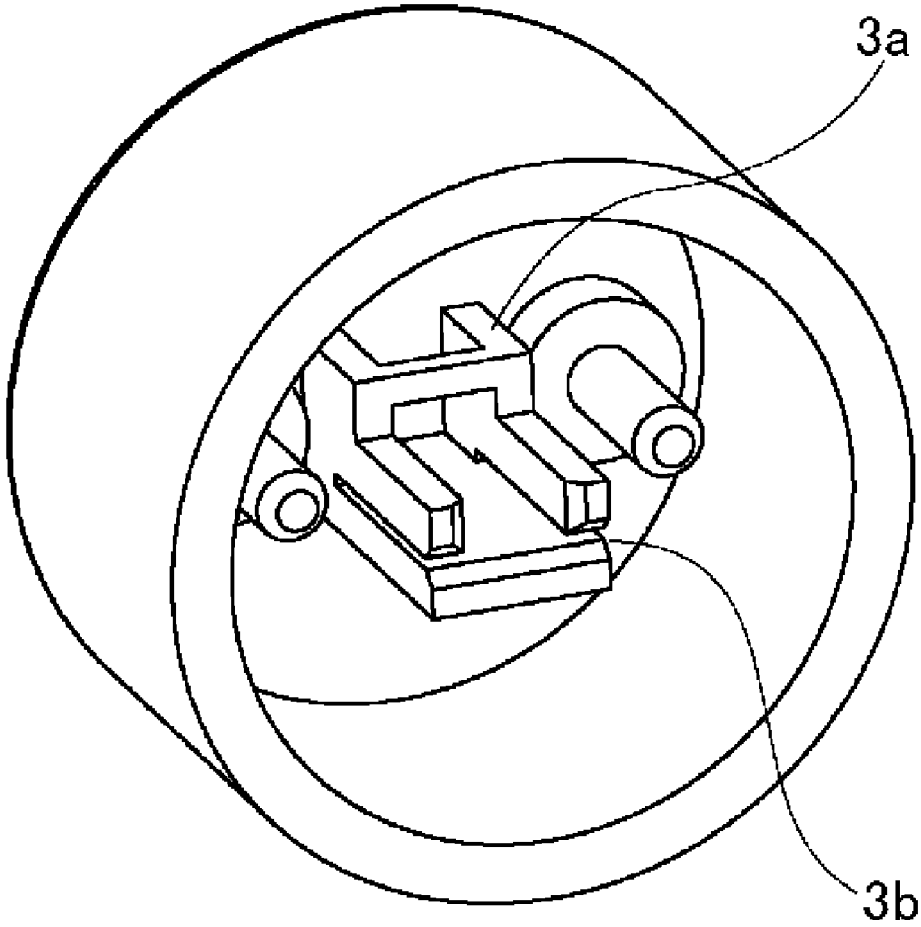
FIG. 4 is an internal perspective view of the cap 3 according to Embodiment Example 1.

The cap 3 having a pair of pin terminals 2 made of a copper alloy sized to suit to an already installed fluorescent light fixture is joined to each end of the main body 1, and has a structure removable from the main body 1 for internal maintenance. Although FIG. 3 shows a cap 3 integrally formed with a pair of pin terminals 2 using an insulation resin, the pair of pin terminals 2 may be attached to the cap 3 by press fit or swaging. In addition, as shown in FIG. 4, a groove 3*b* for assembling the connecting terminal 6 and a lock engaging section 3*a* for engaging the lock section 6*c* of the connecting terminal 6 are formed within the cap 3. Note that the material of the cap 3 may be metal, not limited to an insulation resin, as long as the pin terminal 2 and the cap 3 are electrically insulated from each other for avoiding electric shock. The groove 3*b* holds the connecting terminal 6. The groove 3*b* may be an example of a holding section.

An electric control circuitry for rectification and voltage control (not shown in the drawings) and a plurality of LEDs 5 are mounted to the print substrate 4, and the electric wire 7 to which the connecting terminal 6 is attached is drawn from an end of the print substrate 4. The print substrate 4 is accommodated in the main body 1. The LEDs 5 in this example are surface-mounting white LEDs, but may be shell-type LEDs. The number of LEDs 5 is defined according to the specification of illumination.

Figure 5:
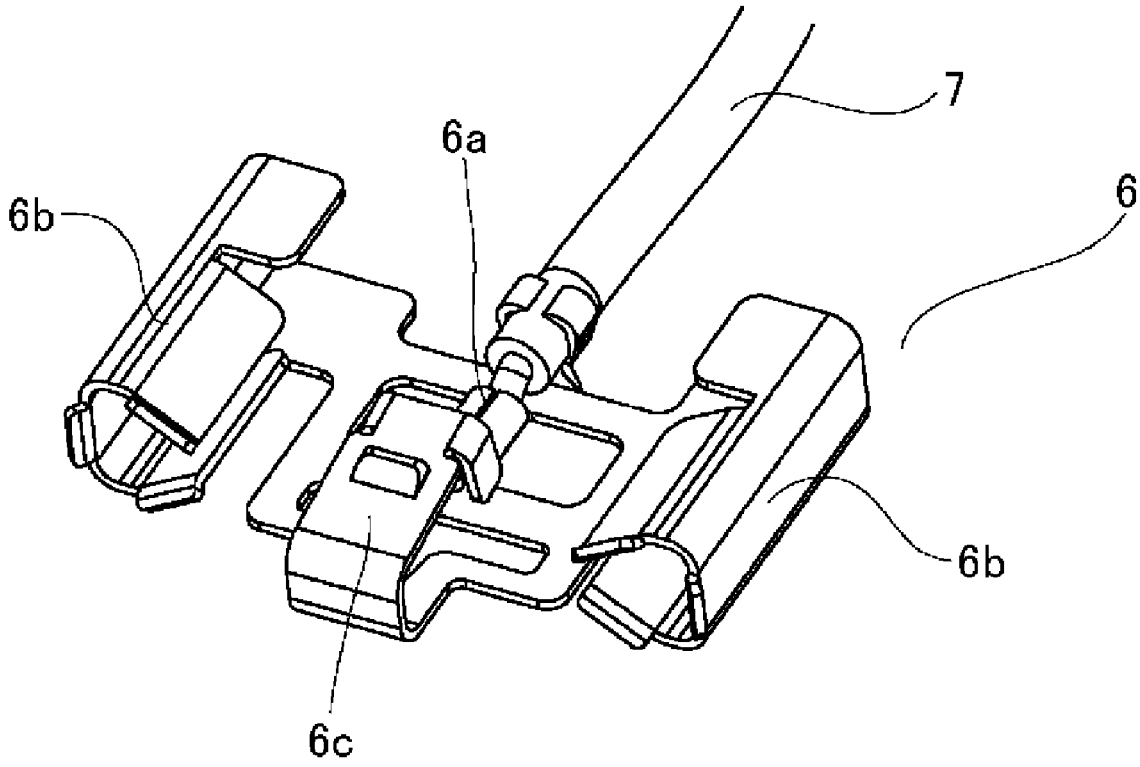
FIG. 5 is a perspective view of a connecting terminal 6 according to Embodiment Example 1.
Figure 6:
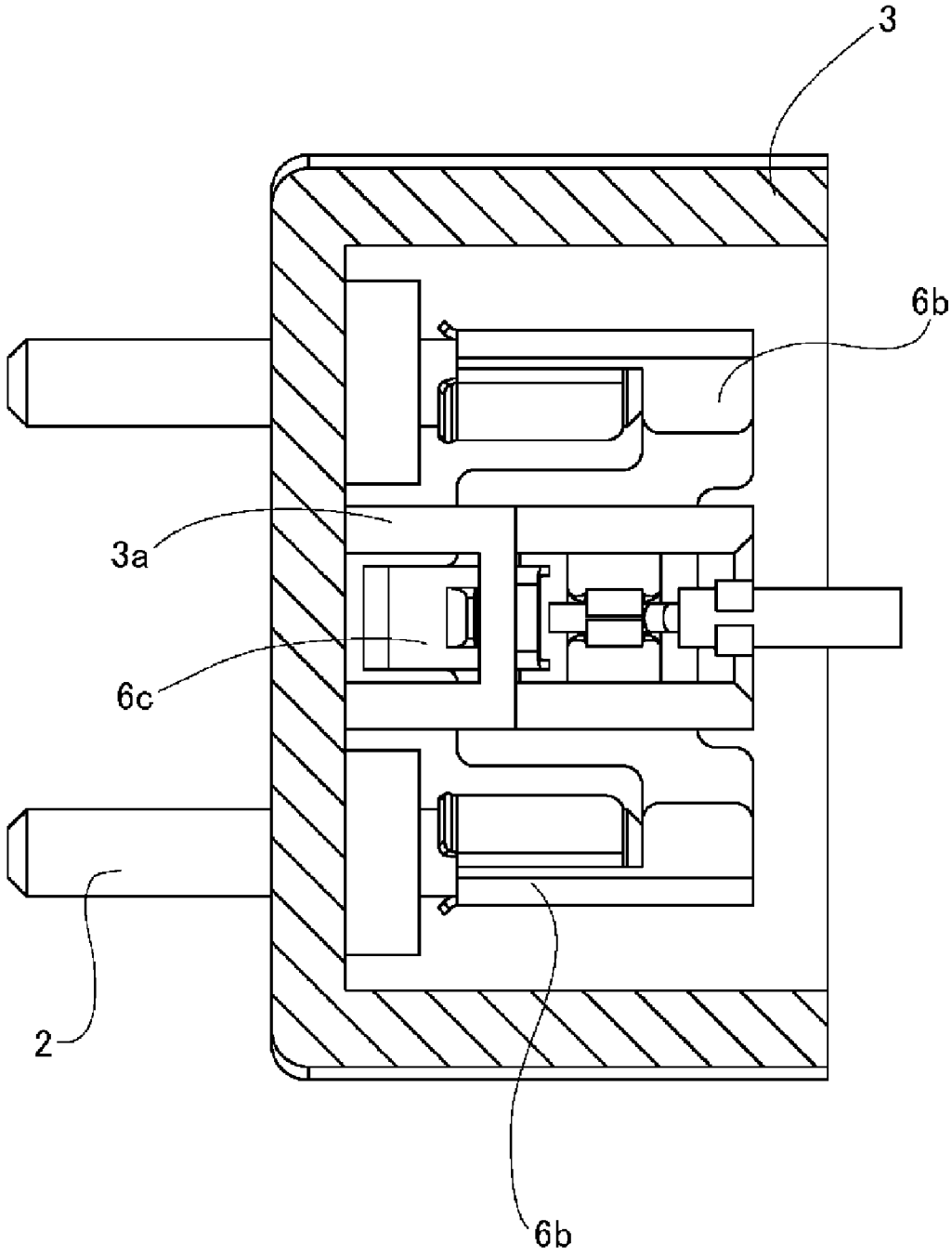
FIG. 6 shows the state in which the cap 3 is assembled with the connecting terminal 6 according to Embodiment Example 1.
Figure 7:
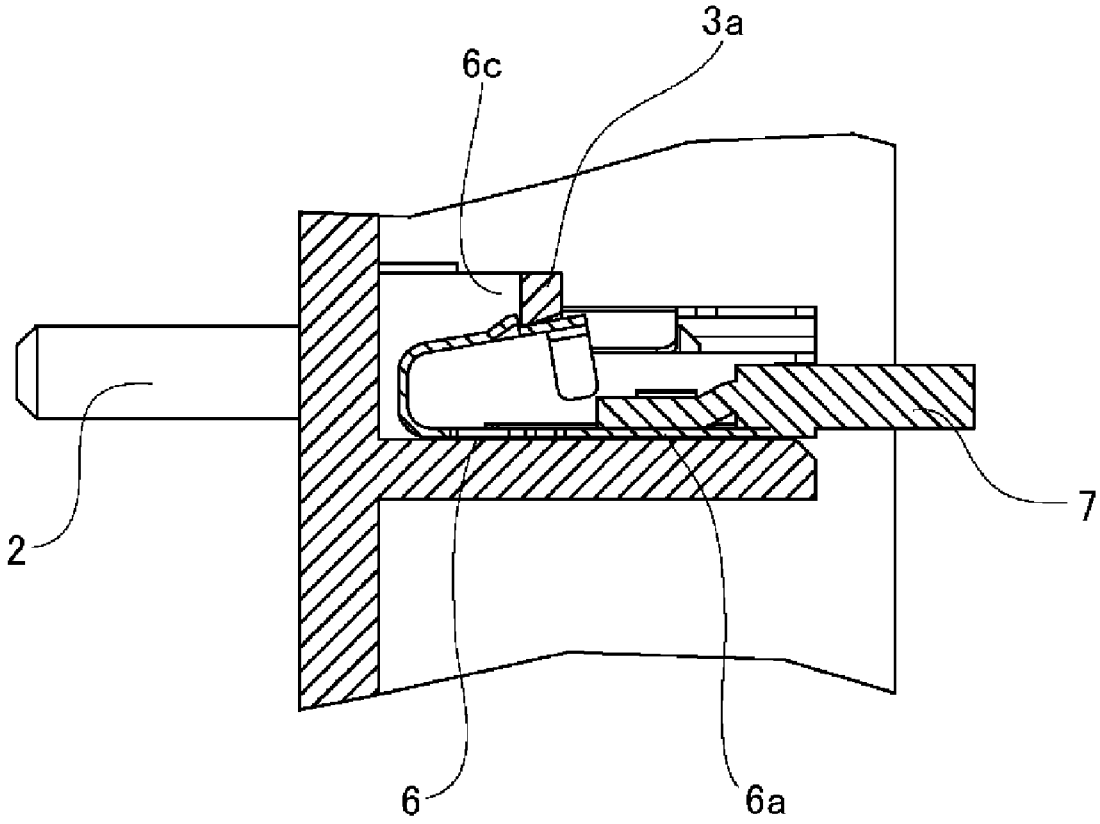
FIG. 7 shows a sectional view of the state in which the cap 3 is assembled with the connecting terminal 6 according to Embodiment Example 1.

The connecting terminal 6 is fabricated by press working a copper alloy, and is configured by a crimp section 6*a*, pin terminal connecting sections 6*b*, and a lock section 6*c* as shown in FIG. 5. The electric wire 7 is connected to the crimp section 6*a*. There are two pin terminal connecting sections 6*b*, to allow connection by inserting the pair of pin terminals 2 therethrough. As shown in FIG. 6 and FIG. 7, the lock section 6*c* has a U-shaped sectional form, and an end thereof is bent to be engaged with the lock engaging section 3*a* of the cap 3, to hold the connecting terminal 6. Note that the elasticity of the lock section 6*c* facilitates removal of the connecting terminal 6 from the cap 3 using a simple tool to cancel the lock. Moreover, by introducing the connecting terminal 6 into the groove 3*b* of the cap 3, the shock from the electric wire 7 is prevented. The above structure allows to exchange the parts such as an LED illuminating section and/or the LED itself with ease. The pin terminals 2 can be connected to the print substrate 4 with ease using only a single electric wire 7 and the connecting terminal 6.

Embodiment Example 2

Figure 8:
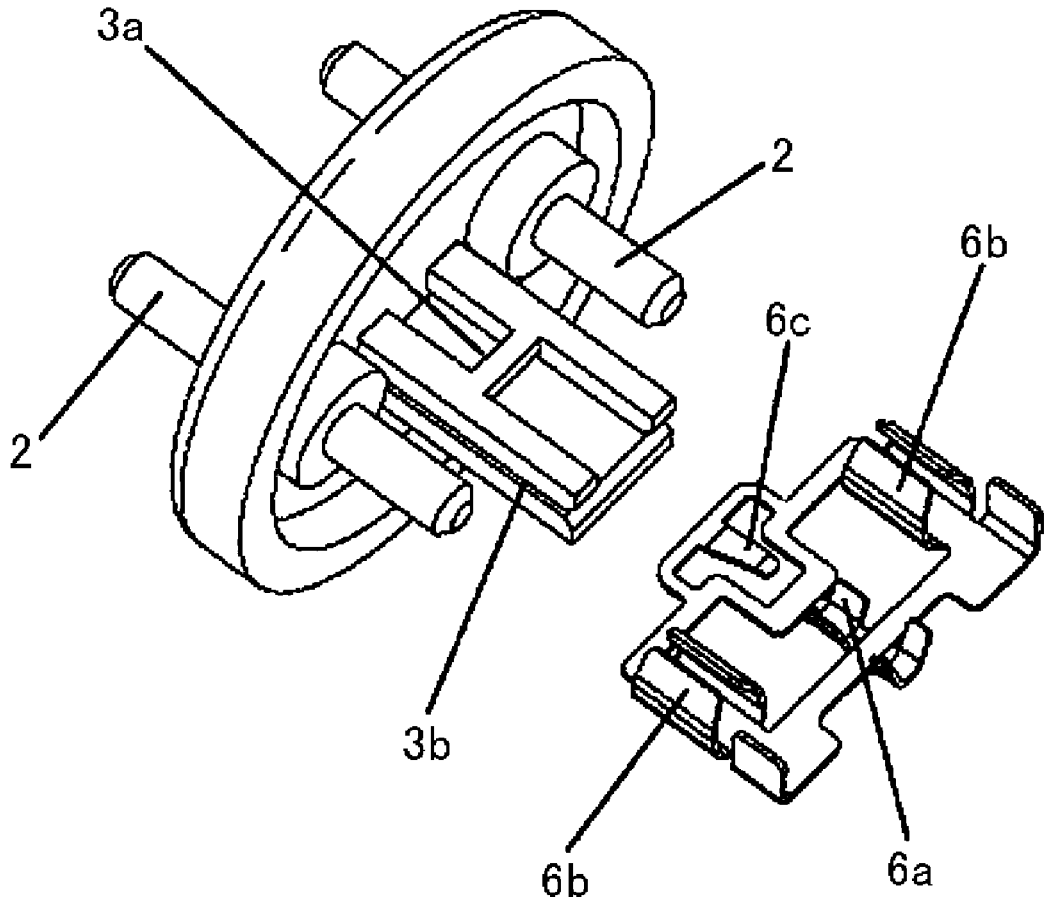
FIG. 8 is a perspective view of a cap 3 and a connecting terminal 6 according to Embodiment Example 2.

FIG. 8 shows a cap 3 and a connecting terminal 6 according to Embodiment Example 2. The only difference of the lock section 6*c* in Embodiment Example 2 from its counterpart in Embodiment Example 1 is that the lock section 6*c* in Embodiment Example 2 has a tongue-like shape. The lock section 6*c* is bent to be engaged with the lock engaging section 3*a* of the cap 3, thereby holding the connecting terminal 6. Note that the elasticity of the lock section 6*c* facilitates removal of the connecting terminal 6 from the cap 3 using a simple tool to cancel the lock. This also allows the cap 3 to hold the connecting terminal 6 with a simple structure, without using any additional parts.

Embodiment Example 3

Figure 9:
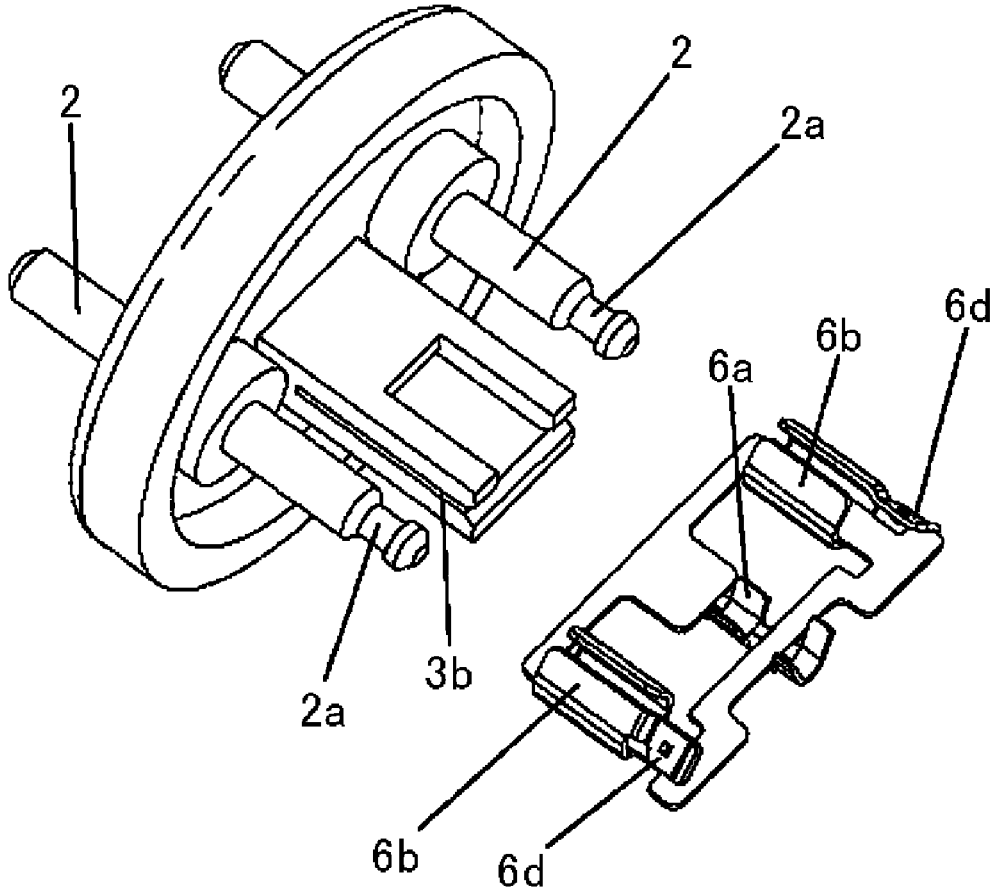
FIG. 9 is a perspective view of a cap 3 and a connecting terminal 6 according to Embodiment Example 3.
Figure 10:
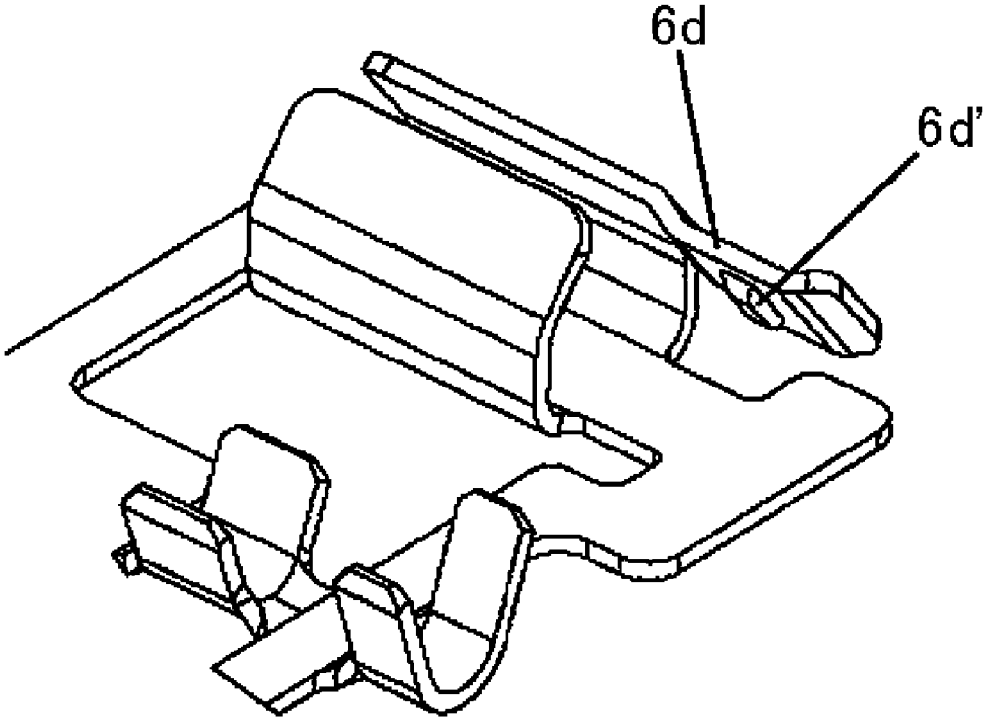
FIG. 10 is an enlarged view of a lock section 6*d* according to Embodiment Example 3.
Figure 11:
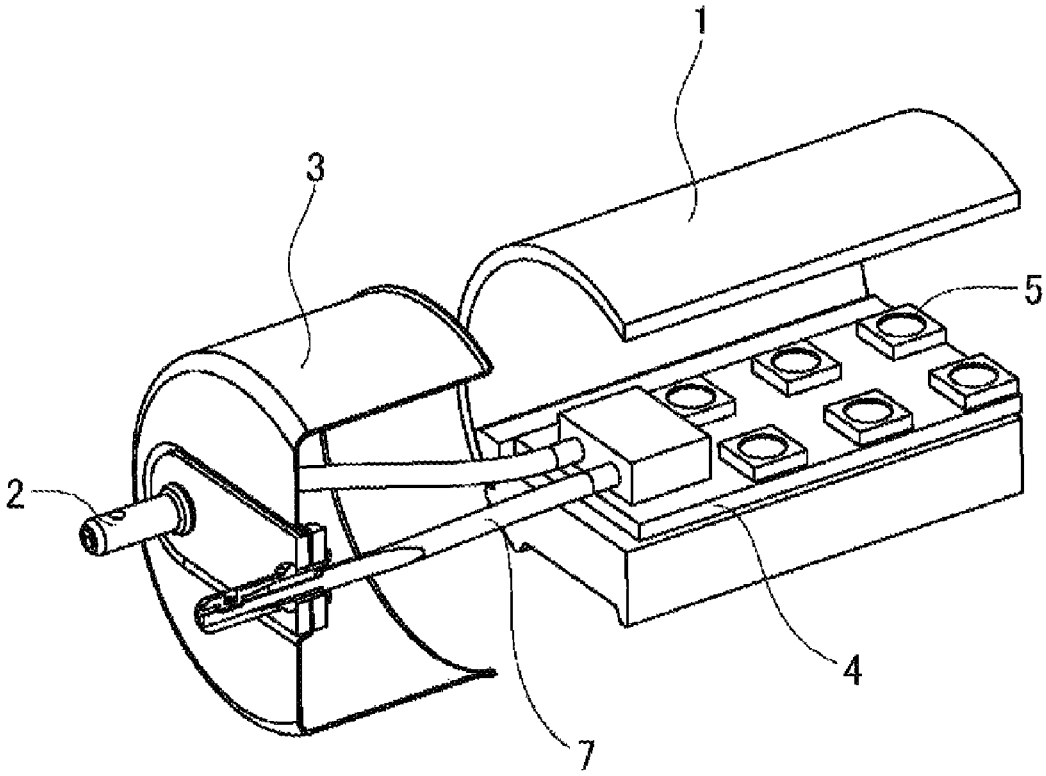
FIG. 11 Prior Art
FIG. 11 is an exploded sectional view of a conventional LED illumination apparatus.
Figure 12:
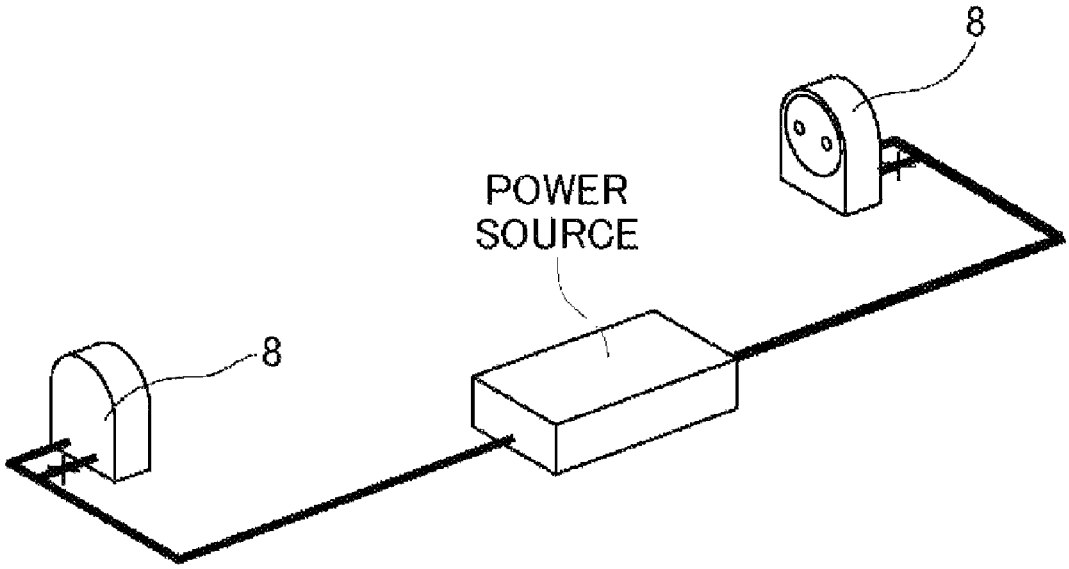
FIG. 12 Prior Art
FIG. 12 is a wiring diagram of a fluorescent light fixture.
Figure 13A:
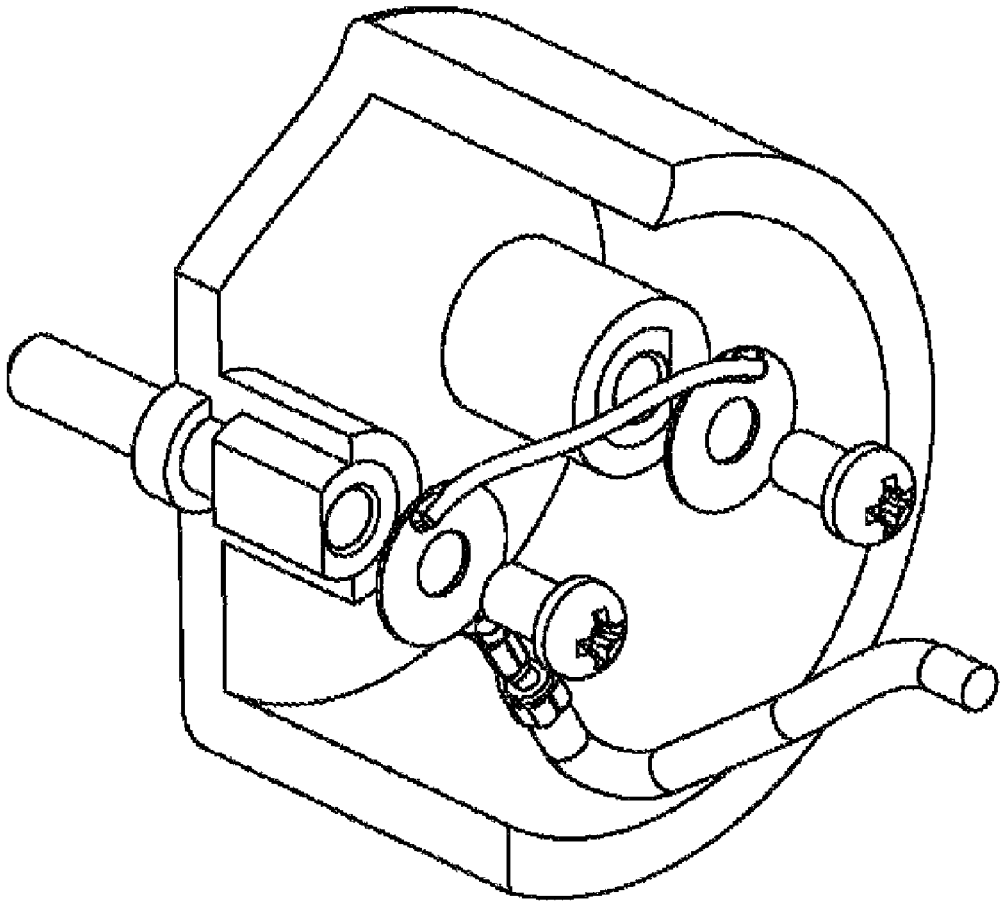
FIG. 13A Prior Art
FIGS. 13A and 13B are a connection diagram for a conventional LED illumination apparatus.
Figure 13B:
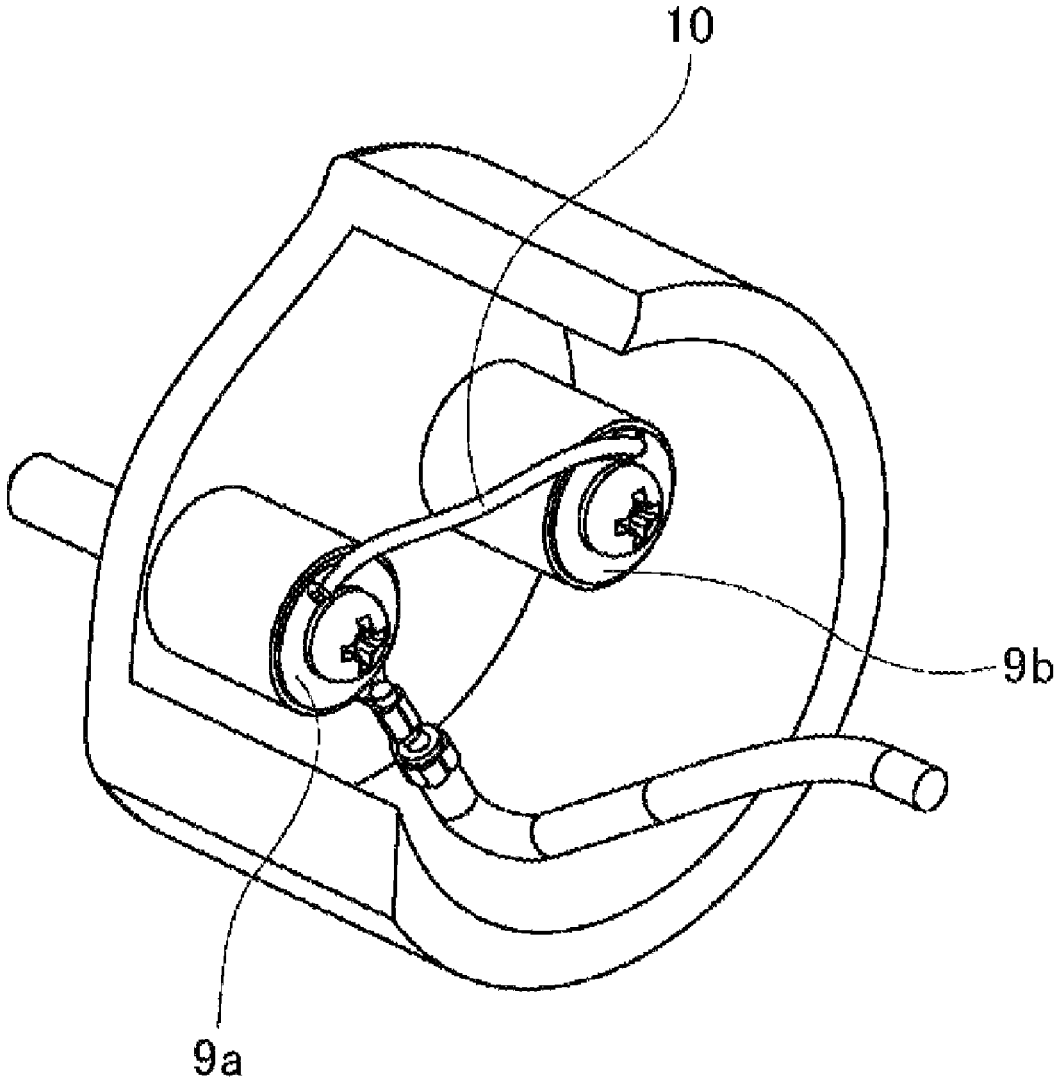
FIG. 13B Prior Art

FIG. 9 shows a cap 3 and a connecting terminal 6 according to Embodiment Example 3. The following explains only the differences from Embodiment Example 1. Each pin terminals 2 according to Embodiment Example 3 is provided with a groove 2*a*. A lock section 6*d* is formed on the connecting terminal 6. The lock section 6*d* is provided in the vicinity of the pin terminal connecting section 6*b*, so as to be engaged with the groove 2*a*, and holds the connecting terminal 6 by being engaged with the groove 2*a* by means of the elasticity of the lock section 6*d*. As shown in FIG. 10, by being provided with a protrusion 6*d*', the lock section 6*d* is assuredly engaged with the groove 2*a*. Note that the elasticity of the lock section 6*d* facilitates removal of the connecting terminal 6 from the cap 3 using a simple tool to cancel the lock. In this way, according to the configuration of Embodiment Example 3, the cap 3 is not necessarily provided with a lock engaging section 3*a*, unlike in the case of Embodiment Example 1, and so Embodiment Example 3 advantageously simplify the structure of a mold for shaping the cap 3.

The present invention is applicable to an LED illumination apparatus that uses an LED (light emitting diode) attached to a socket of a fluorescent light fixture.

What is claimed is:

1. An LED illumination apparatus comprising:

a cap having a terminal configured to be electrically coupled to a socket of a fluorescent light fixture; and a main body having an end configured to be coupled with the cap, wherein the main body includes:

an LED; and a coupler to electrically couple the terminal to the LED, the terminal being removably coupled with the coupler so as to be electrically connected to the coupler, the coupler includes a terminal connecting section configured to be removably coupled to the terminal by inserting the terminal therethrough, the terminal is electrically connected to the coupler when the terminal is inserted in the terminal connecting section, the terminal is a pair of pin terminals, the terminal connecting section is a pair of pin connecting sections that correspond to the pair of pin terminals on a one-to-one basis, the cap further includes a lock engaging section, and the coupler further includes a lock section integrally formed with a portion of the coupler between the pair of pin connecting sections, the lock section being configured to removably engage with the lock engaging section.

2. An LED illumination apparatus comprising:

a cap having a terminal configured to be electrically coupled to a socket of a fluorescent light fixture; and a main body having an end configured to be coupled with the cap, wherein the main body includes:

an LED; and a coupler to electrically couple the terminal to the LED, the terminal being removably coupled with the coupler so as to be electrically connected to the coupler, the coupler includes a terminal connecting section configured to be removably coupled to the terminal by inserting the terminal therethrough, the terminal is electrically connected to the coupler when the terminal is inserted in the terminal connecting section, the terminal includes a groove, and the coupler further includes a lock section integrally formed with the terminal connecting section, the lock section being configured to removably engage with the groove.

* * * * *